US010056213B1

(12) United States Patent
Kuan

(10) Patent No.: US 10,056,213 B1
(45) Date of Patent: Aug. 21, 2018

(54) ELECTROMAGNETIC SWITCH PROTECTION STRUCTURE

(71) Applicant: Kuo-Lung Kuan, Taichung (TW)

(72) Inventor: Kuo-Lung Kuan, Taichung (TW)

( * ) Notice: Subject to any disclaimer, the term of this patent is extended or adjusted under 35 U.S.C. 154(b) by 0 days.

(21) Appl. No.: 15/488,505

(22) Filed: Apr. 16, 2017

(51) Int. Cl.
*H01H 77/00* (2006.01)
*H01H 50/64* (2006.01)
*H01H 50/04* (2006.01)
*H01H 50/54* (2006.01)

(52) U.S. Cl.
CPC ..... *H01H 50/641* (2013.01); *H01H 50/04* (2013.01); *H01H 50/54* (2013.01); *H01H 2235/01* (2013.01)

(58) Field of Classification Search
CPC ..... H01H 50/50; H01H 50/04; H01H 50/641
USPC ..... 335/156
See application file for complete search history.

(56) References Cited

U.S. PATENT DOCUMENTS 1,630,650 A * 5/1927 Bliss ..... H01H 73/44 335/174
1,694,250 A * 12/1928 Clarkson ..... H02P 1/20 335/183
1,750,895 A * 3/1930 Leyhausen ..... H01H 73/44 218/26
2,050,076 A * 8/1936 Wilms ..... H02P 1/02 200/5 R
3,040,142 A * 6/1962 Dietrich ..... H01H 13/023 200/16 A
3,924,115 A * 12/1975 Hampton ..... F21V 33/008 294/65.5
4,871,893 A * 10/1989 Slovak ..... H01H 3/0213 174/66

* cited by examiner

*Primary Examiner* — Shawki S Ismail
*Assistant Examiner* — Lisa Homza
(74) *Attorney, Agent, or Firm* — Raymond Y. Chan; David and Raymond Patent Firm

(57) ABSTRACT

An electromagnetic switch protection structure includes a power-off key located between a press assembly and a contact seat. The power-off key is provided with a press portion extending downward. The press portion directly presses an elastic seat of the electromagnetic switch. When a power-off button is pressed, movable contacts of the elastic seat can be immediately separated from immovable contacts of electrode plates to cut off the power supply of the electromagnetic switch. That is, the press assembly is slightly touched to cut off the power supply, not pressing deep to cause an erroneous pressing, to avoid damage to the electromagnetic switch, achieving the protection of the electromagnetic switch.

2 Claims, 11 Drawing Sheets

ELECTROMAGNETIC SWITCH PROTECTION STRUCTURE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an electromagnetic switch protection structure, and more particularly to an electromagnetic switch able to cut off the power supply immediately when a power-off button is pressed.

Description of Related Arts

As shown in FIG. 1 to FIG. 4, a conventional electromagnetic switch 10 comprises a housing 11, an electromagnetic assembly 12, a contact assembly 13, and a press assembly 14. The housing 11 has two opposing rail grooves 111 on an inner wall thereof. The electromagnetic assembly 12 is mounted in the housing 11. The electromagnetic assembly 12 includes a coil holder 121 and an actuating plate 122. The actuating plate 122 is pivotally mounted on the coil holder 121, and is formed with an interlocking end 123 and a magnetic end 124. The magnetic end 124 is located on the coil holder 121. The contact assembly 13 includes a contact seat 131 and at least two corresponding electrode plates 132. A top end of the contact seat 131 is formed with a through hole 133. Left and right sides of the contact seat 131 are provided with accommodation troughs 134, respectively. The contact seat 131 is slidably disposed on the rail grooves 111. The through hole 133 is adapted to receive the interlocking end 123 of the actuating plate 122. The contact seat 131 is provided with at least one elastic seat 135. Two ends of the elastic seat 135 have movable contacts 136 in communication with each other. The electrode plates 132 are located at front and rear sides of the contact seat 131, respectively. The electrode plates 132 are inserted and mounted to an inner bottom of the housing 11, each having a vertically bent immovable contact 137 at a top end thereof. One of the electrode plates 132 is in communication with the coil holder 121. The movable contacts 136 of the elastic seat 135 are adapted to get contact with or separated from the immovable contacts 137 of the electrode plates 132. The press assembly 14 is buckled on the housing 11. A power-on button 141 and a power-off button 142 are provided on the outside of the press assembly 14. The power-on button 141 corresponds to the magnetic end 124 of the actuating plate 122. The power-off 142 is located above the contact seat 131. A gap is defined between the power-on button 141 and the magnetic end 124. A gap is defined between the power-off button 142 and the contact seat 131. Elastic members 15 are provided between the press assembly 14 and the accommodation troughs 134 of the contact holder 131, respectively. When the contact seat 131 is biased by the elastic members 15 to move downward, the movable contacts 136 of the elastic seat 135 are separated from the immovable contacts 137. The magnetic end 124 of the actuating plate 122 is tilted away from the coil holder 121. With the above structure, when the user wants to turn on the power supply of the electromagnetic switch 10, the power-on button 141 is pressed and then the magnetic end 124 of the actuating plate 122 is pushed downward, so that the interlocking end 123 is tilted to drive the contact seat 131 to move upward and compress the elastic members 15, and the elastic seat 135 is moved upward so that the movable contacts 136 can be elastically compressed and in contact with the immovable contacts 137 for electrical conduction of the electrode plates 132 and the coil holder 121, as shown in FIG. 2. When the power-on button 141 is released, the magnetic end 124 is still attracted by the energized coil holder 121 to keep the electrode plates 132 conductive. On the other hand, when the user wants to cut off the power supply of the electromagnetic switch 10, the power-off button 142 is pressed against the top of the contact seat 131, and the contact seat 131 is moved downward to push the interlocking end 123 of the actuating plate 122 downward, and the magnetic end 124 is tilted away from the coil holder 121. The power-off button 142 is continuously pressed until the elastic seat 135 is moved downward to separate the movable contacts 136 from the immovable contacts 137 so that the electrode plates 132 and the coil holder 121 are not conductive. Thus, the magnet end 124 is no longer attracted by the de-energized coil holder 121, and the power supply of the electromagnetic switch can be reliably cut off.

However, when the above-described electromagnetic switch 10 is powered off, the power-off button 142 must be pressed deep for a large stroke until the elastic seat 135 is moved downward to separate the movable contacts 136 from the immovable contacts 137. When the power supply of the electromagnetic switch 10 is quickly and immediately cut off in an emergency, the operation of deep pressing the power-off button 142 may erroneously press the power-on button 141 at the same time, so that two ends of the actuating plate 122 made of a metal ferromagnetic material are pressed at the same time, and the actuating plate 122 is bent downward and deformed (as shown in FIG. 3). Even if the operator stops pressing the power-off button 142 as soon as the machine stops running, it is possible to destroy the actuating angle of the actuating plate 122. As a result, when the power supply of the electromagnetic switch 10 is powered on next time, the interlocking end 123 of the actuating plate 122 cannot be tilted to the predetermined position by pressing the power-on button 141 (as shown in FIG. 4), so the movable contacts 136 cannot be brought to get contact with the immovable contacts 137, and the electrode plates 132 and the coil holder 121 cannot be conductive. The electromagnetic switch 10 is damaged and needs to be replaced. Accordingly, the inventor of the present invention has devoted himself based on his many years of practical experiences to solve these problems.

SUMMARY OF THE PRESENT INVENTION

The primary object of the present invention is to solve the aforesaid problems and to provide an electromagnetic switch protection structure. The main technique of the present invention is that a power-off key is provided between a power-off button and a contact seat. When the power-off button is pressed, an elastic seat of the contact seat can be directly pushed to separate the elastic seat from electrode plates the first time, such that the power supply is cut off immediately and the magnetic state of the actuating plate is released, preventing the electromagnetic switch from being damaged because of an improper operation.

DETAILED DESCRIPTION OF THE PREFERRED EMBODIMENT

Figure 1:
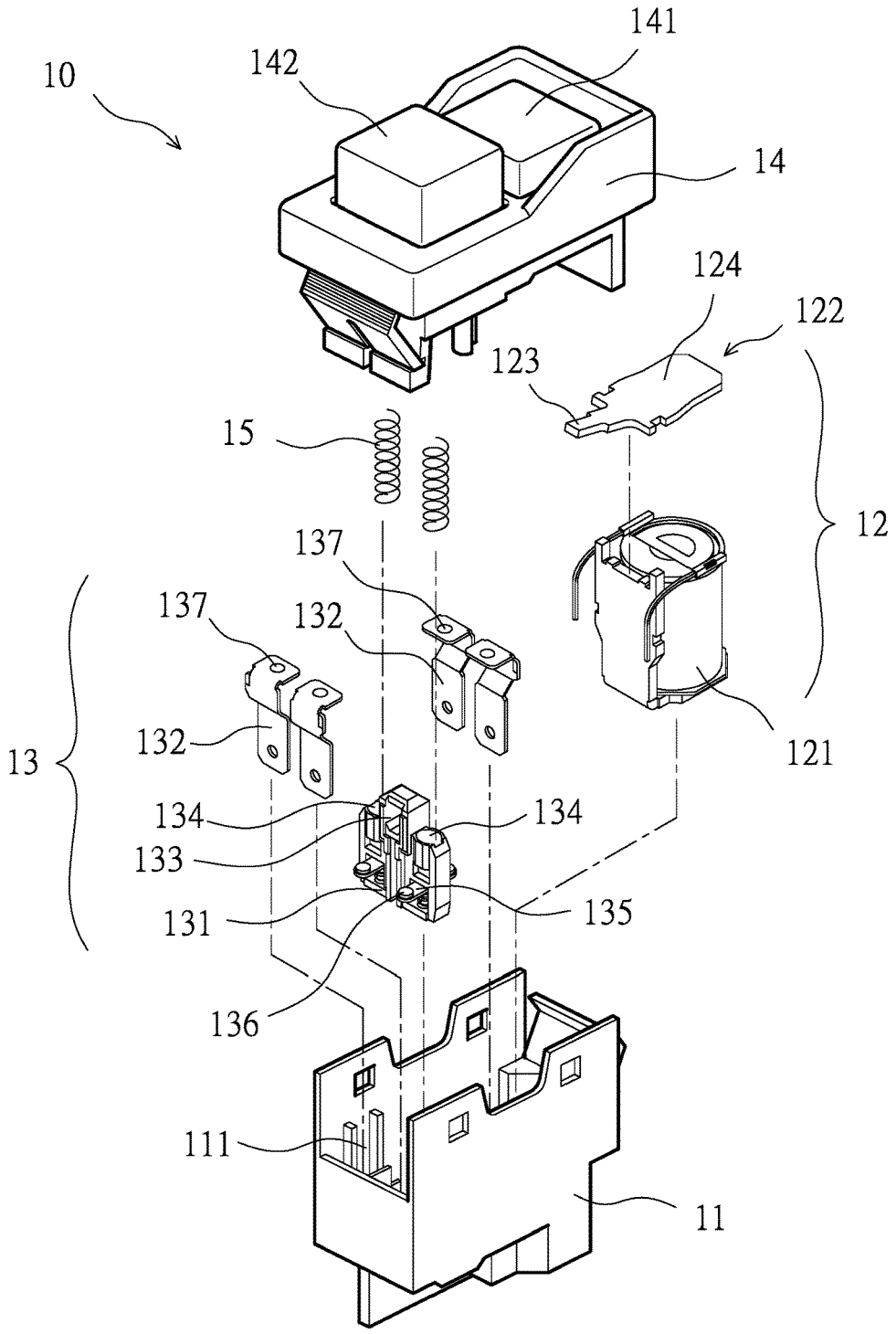
FIG.1 PRIOR ART
FIG. 1 is an exploded view of a conventional electromagnetic switch.
Figure 2:
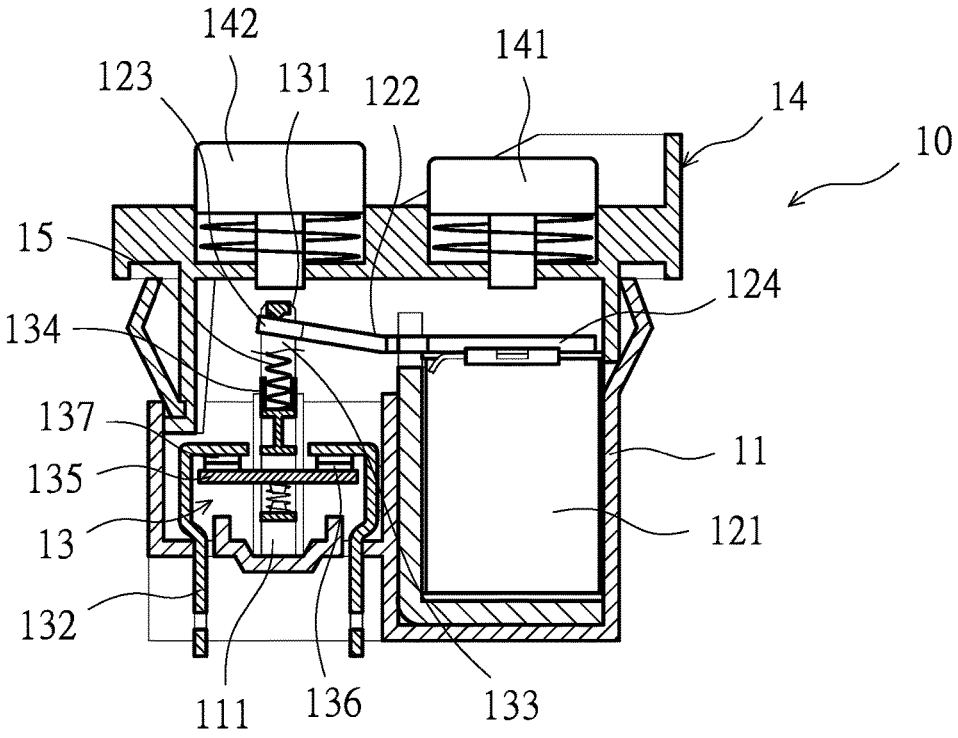
FIG.2 PRIOR ART
FIG. 2 is a sectional view of the conventional electromagnetic switch in an energized state.
Figure 3:
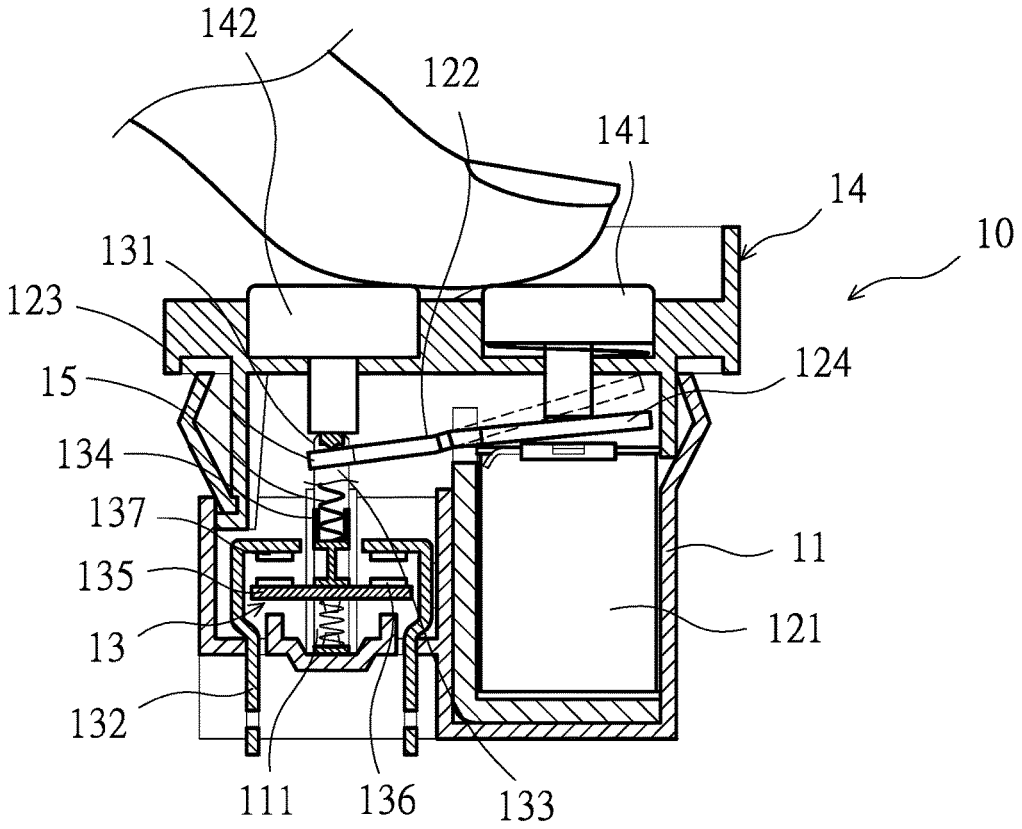
FIG.3 PRIOR ART
FIG. 3 is a sectional view of the conventional electromagnetic switch, showing that the actuating plate is deformed due to erroneous pressing.
Figure 4:
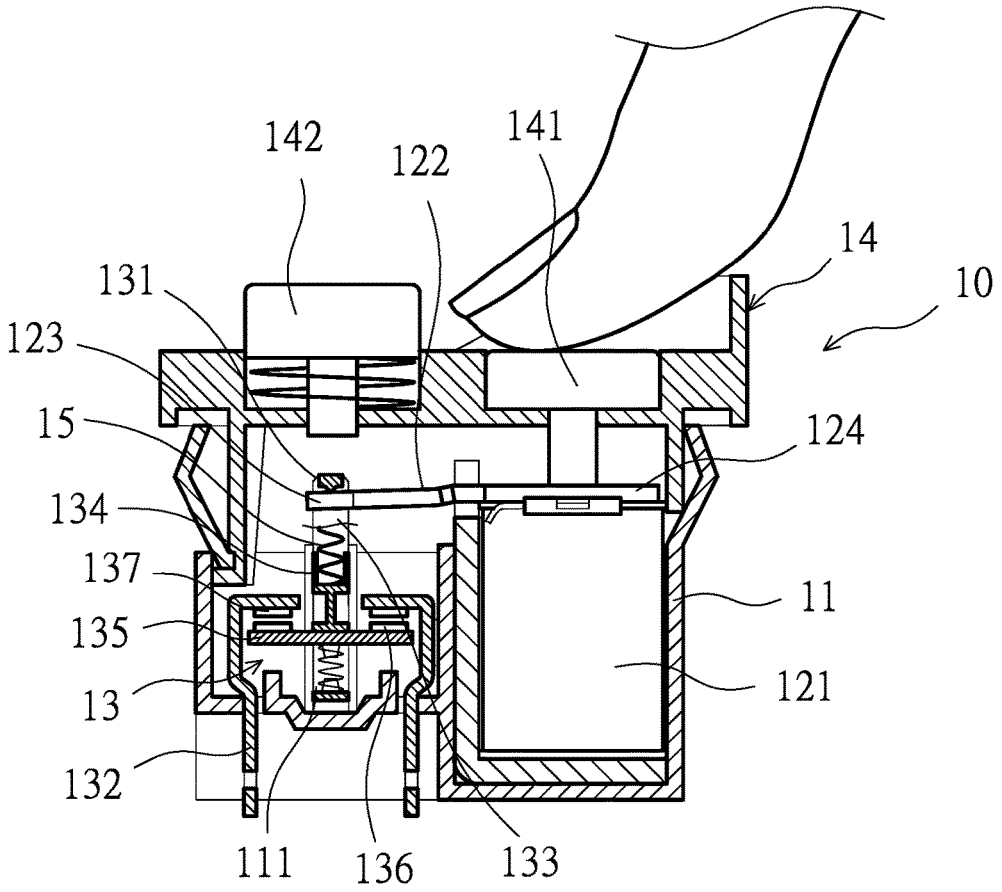
FIG.4 PRIOR ART
FIG. 4 is a sectional view of the conventional electromagnetic switch, showing that the power supply is not conductive because of the deformation of the actuating plate.
Figure 5:
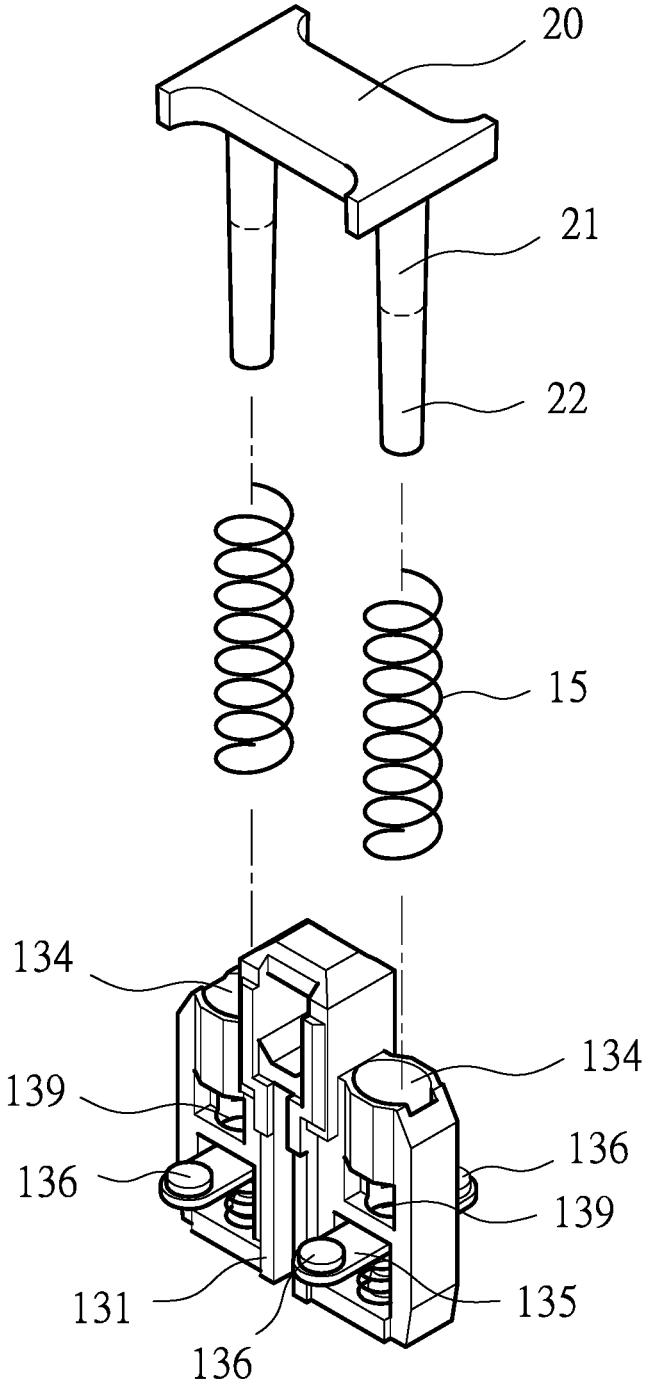
FIG. 5 is an exploded view of the contact seat and the power-off key of the present invention.
Figure 6:
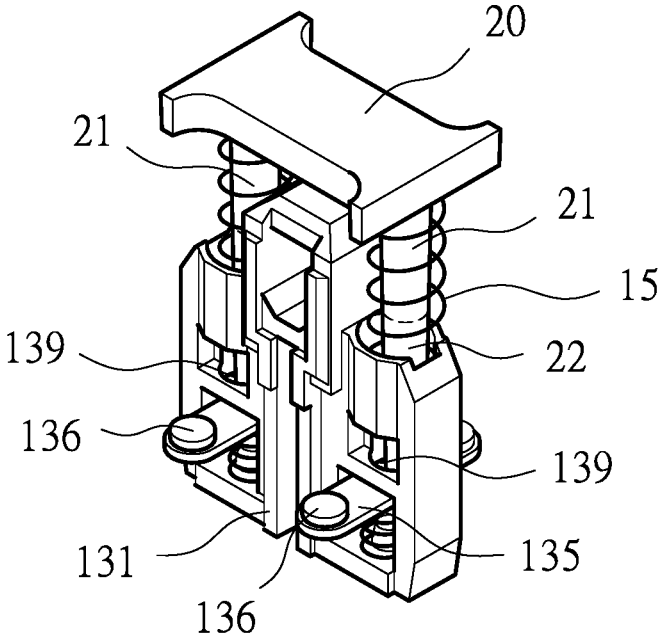
FIG. 6 is an assembled perspective view of the contact seat and the power-off key of the present invention.

Embodiments of the present invention will now be described, by way of example only, with reference to the accompanying drawings.

Referring to FIG. 5 to FIG. 9, an electromagnetic switch protection structure comprises a housing 11, an electromagnetic assembly 12 mounted in the housing 11, a contact assembly 13, and a press assembly 14 buckled on the housing 11. The electromagnetic assembly 12 comprises a coil holder 121 and an actuating plate 122. The actuating plate 122 is pivotally mounted on the coil holder 121, so that the actuating plate 122 is formed with an interlocking end 123 and a magnetic end 124. The magnetic end 124 is located on the coil holder 121. The contact assembly 13 includes a contact seat 131 and at least two opposing electrode plates 132. Left and right sides of the contact seat 131 are provided with accommodation troughs 134, respectively. The contact seat 131 is provided with at least one elastic seat 135. Two ends of the elastic seat 135 have movable contacts 136 in communication with each other. The electrode plates 132 are located at front and rear sides of the contact seat 131, respectively. One of the electrode plates 132 is in communication with the coil holder 121. The electrode plates 132 are inserted and mounted to an inner bottom of the housing 11, each having a vertically bent immovable contact 137 at a top end thereof. The movable contacts 136 of the elastic seat 135 are adapted to get contact with or separated from the immovable contacts 137 of the electrode plates 132. A power-on button 141 and a power-off button 142 are provided on the outside of the press assembly 14. The power-on button 141 corresponds to the magnetic end 124 of the actuating plate 122. The power-off button 142 is located above the contact seat 131. The interlocking end 123 is used to drive the contact seat 131. The present invention is characterized in that a power-off key 20 is provided between the press assembly 14 and the contact seat 131. Two sides of the bottom of the power-off key 20 have positioning rods 21 corresponding to the accommodation troughs 134, respectively. The positioning rods 21 are sleeved with elastic members 15 and mounted in the accommodation troughs 134, respectively. Preferably, the elastic members 15 are compression springs. One end of each elastic member 15 leans against the bottom of the power-off key 20, and another end of each elastic member 15 is spaced a determined distance apart from a top end of the contact seat 131. The bottom of the power-off button 142 is pressed against the top of the power-off key 20. The bottom of the each accommodation trough 134 is formed with a perforation 138. A lower end of each positioning rod 21 extends downward to form a press portion 22. The press portion 22 passes through the perforation 138 to press the elastic seat 135. Through the above-described structure, when the power-off button 142 is pressed, the movable contacts 136 can be separated from the immovable contacts 137 directly to cut off the power supply of the electromagnetic switch 10 so that the magnetic end 124 is no longer attracted by the coil holder 121. The elastic members 15 are moved downward to push the contact seat 131 to link the interlocking end 123 of the actuating plate 122. The magnetic end 124 is tilted away from the coil holder 121, such that the power-on button 141 and the power-off button 142 of the electromagnetic switch 10 won't be erroneously pressed at the same time, preventing the actuating plate 122 from being deformed to damage the electromagnetic switch 10.

Figure 7:
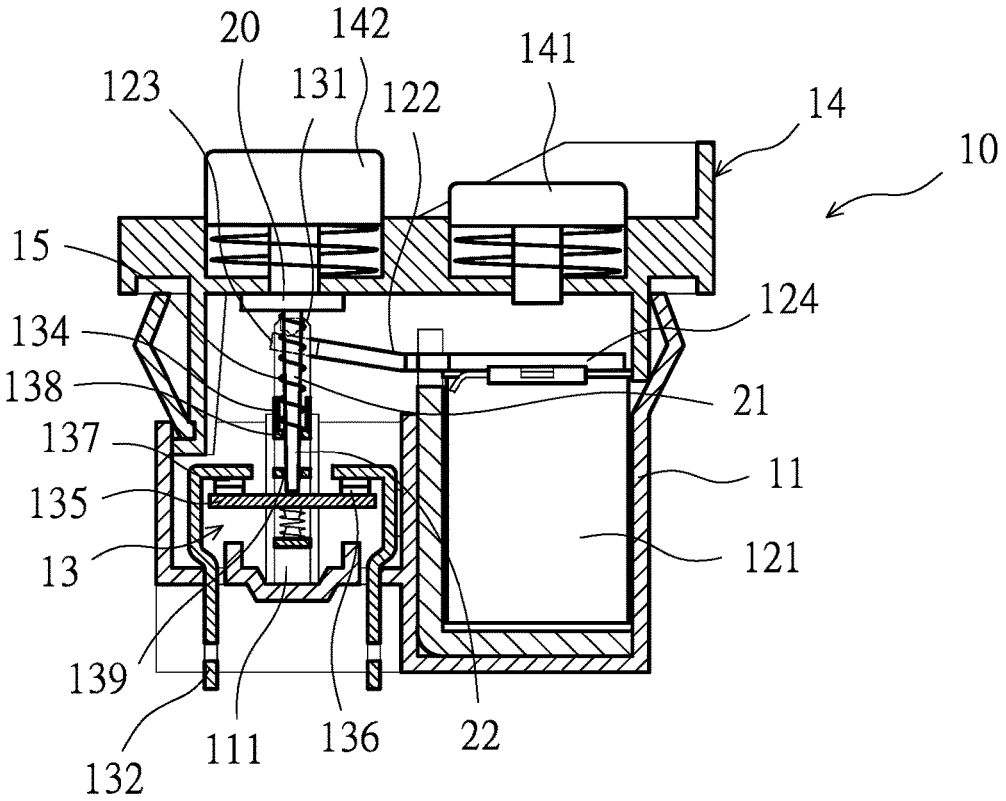
FIG. 7 is a sectional view of the present invention in an energized state.
Figure 8:
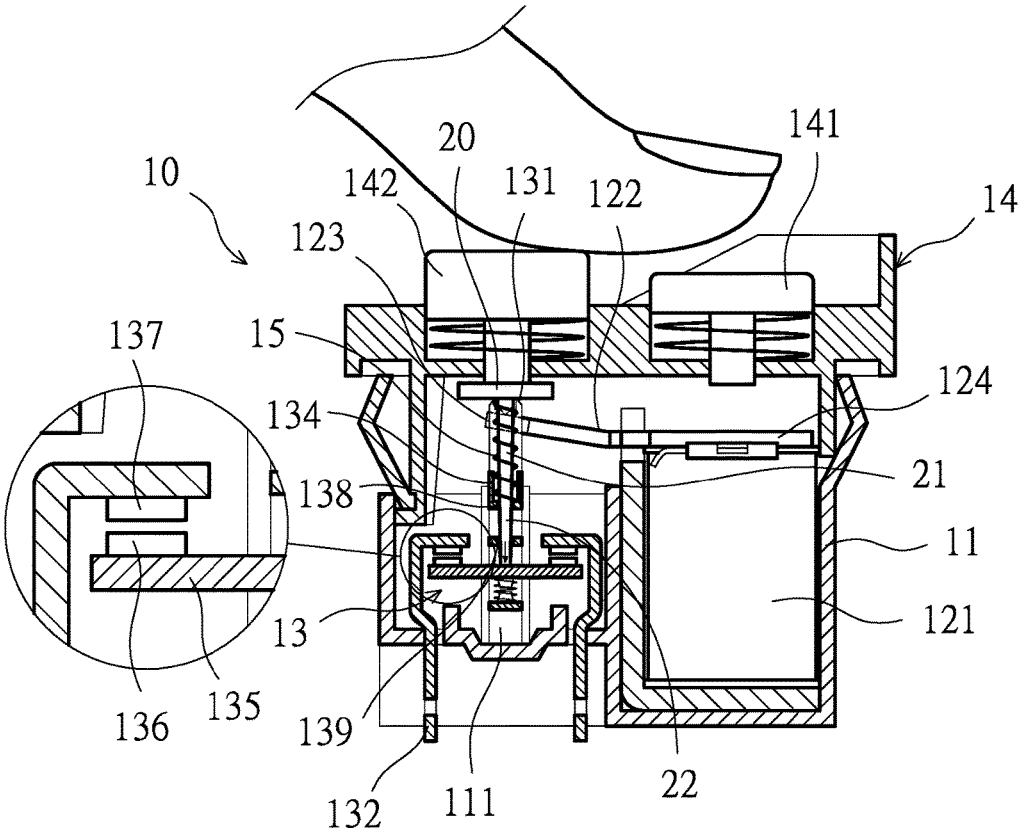
FIG. 8 is a schematic view of the present invention, showing the operation to cut off the power supply.
Figure 9:
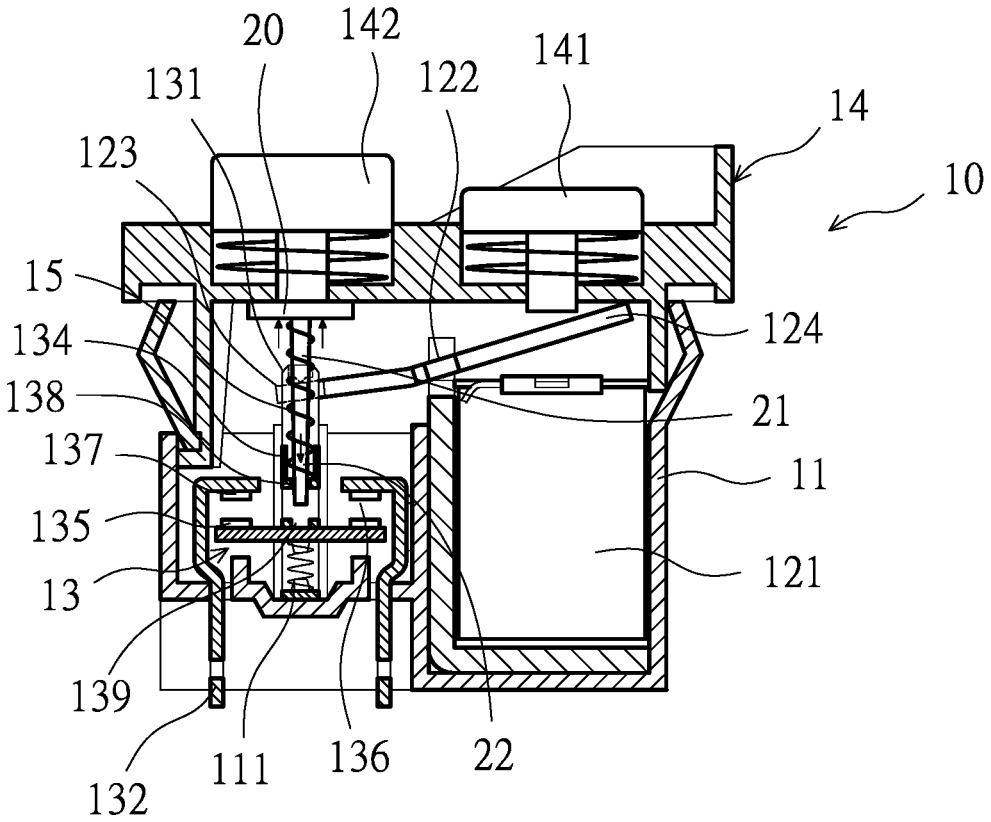
FIG. 9 is a sectional view of the present invention in a de-energized state.

The assembly, the function, and the details of the aforesaid embodiment are described below. Referring to FIG. 5 to FIG. 9, when the user wants to turn on the power supply of the electromagnetic switch 10, the power-on button 141 is pressed and then the magnetic end 124 of the actuating plate 122 is pushed downward, so that the interlocking end 123 is tilted to drive the contact seat 131 to move upward and compress the elastic members 15, and the elastic seat 135 is moved upward. In this embodiment, two sets of elastic seats 135 and two sets of corresponding electrode plates 132 are illustrated. One set of electrode plates 132 may be connected to the positive electrode of the power supply, and the other set of electrode plates 132 may be connected to the negative electrode of the power supply, so that the movable contacts 136 can be elastically compressed and in contact with the immovable contacts 137 for electrical conduction of the electrode plates 132 and the coil holder 121, as shown in FIG. 7. When the power-on button 141 is released, the magnetic end 124 is still attracted by the energized coil holder 121 to keep the electrode plates 132 conductive. When the user wants to cut off the power supply of the electromagnetic switch 10, the power-off button 142 is pressed against the top of the power-off key 20, and then the press portion 22 passes through the perforation 138 of the contact seat 131 and a through hole 139 under the perforation 138 to press the elastic seat 135. The movable contacts 136 are immediately separated from the immovable contacts 137 to be powered off. At this time, the top of the contact seat 131 has not yet been pressed, without any external force applied to the actuating plate 122. But, since the electromagnetic switch 10 is de-energized, the magnetic end 124 is no longer attracted by the coil holder 121 so that one end of the elastic member 15 leans against the power-off key 20 and the other end leans against the accommodation trough 134. The contact seat 131 is pushed downward to link the interlocking end 123 of the actuating plate 122, so that the magnetic end 124 is tilted away from the coil holder 121. In other words, it is only necessary to "touch", not "press deep", the power-off button 142 to power off the electromagnetic switch 10 the first time. In this way, the power-off button 142 doesn't need a larger (deeper) stroke for the elastic seat 135 to eliminate its elastic contact to be separated from the immovable contacts 137. When in an emergency to cut off the power supply, it is possible to avoid the problem that the electromagnetic switch 10 is damaged when the power-on button 141 is erroneously pressed at the same time.

Figure 10:
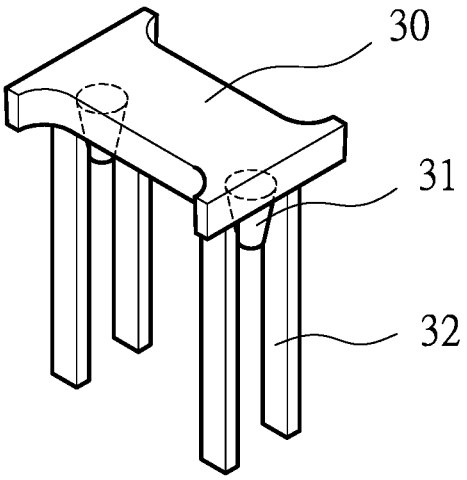
FIG. 10 is a perspective view of another embodiment of the power-off key of the present invention.
Figure 11:
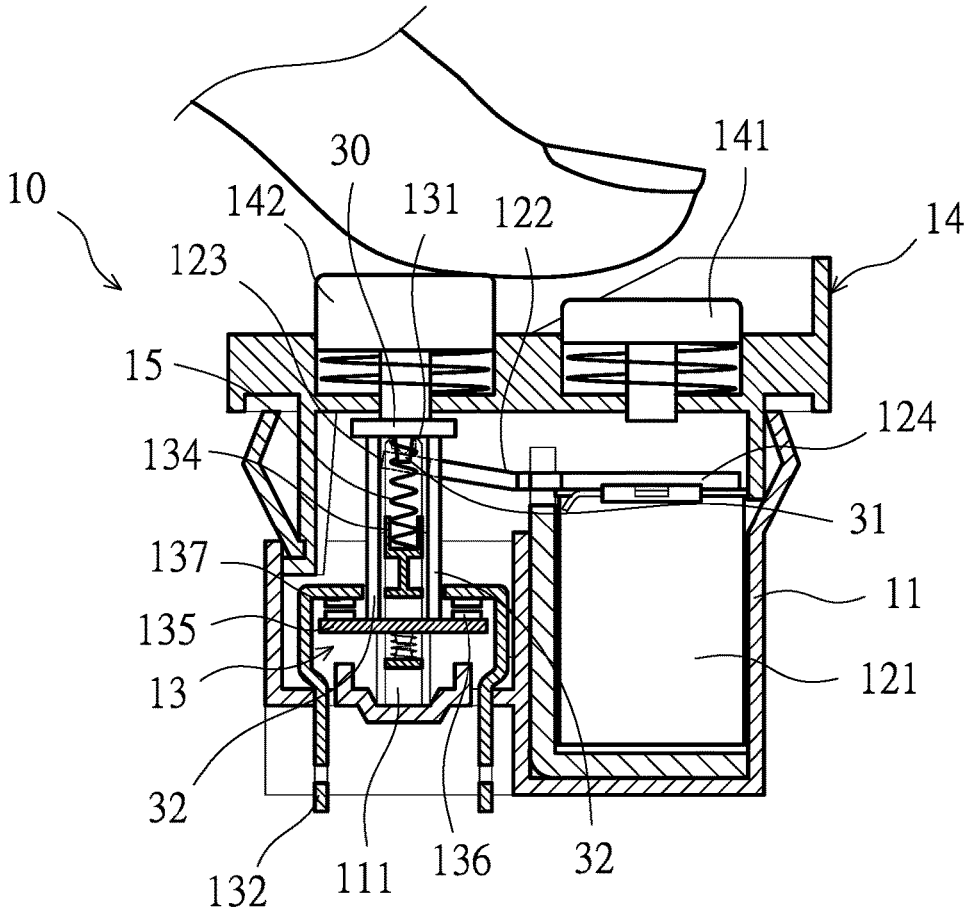
FIG. 11 is a schematic view of another embodiment of the power-off key of the present invention, showing the operation to cut off the power supply.

In addition, according to the above-mentioned technical means, the present invention may be in different embodiments as shown in FIG. 10 and FIG. 11. Two sides of the bottom of the power-off key 30 have positioning rods 31 corresponding to the accommodation troughs 134, respectively. The positioning rods 31 are sleeved with elastic members 15 and mounted in the accommodation troughs 134, respectively. One end of each elastic member 15 leans against the bottom of the power-off key 30, and another end of each elastic member 15 is spaced a determined distance apart from a top end of the contact seat 131. The bottom of the power-off button 142 is pressed against the top of the power-off key 30. The periphery of the power-off key 30 is provided with a press portion 32 extending downward. The press portion 32 directly presses the elastic seat 135, as shown in FIG. 11. Through the above-described structure, when the power-off button 142 is pressed, the movable contacts 136 can be separated from the immovable contacts 137 directly to cut off the power supply of the electromagnetic switch 10 so that the magnetic end 124 is no longer attracted by the coil holder 121. The elastic member 15 is moved downward to push the contact seat 131 to link the interlocking end 123 of the actuating plate 122. The magnetic end 124 is tilted away from the coil holder 121. There is no need a large stroke (deep pressing). It is possible to avoid erroneous pressing of the power-on button 141 and the power-off button 142 at the same time, resulting in damage to the electromagnetic switch 10.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electromagnetic switch protection structure, comprising a housing, an electromagnetic assembly mounted in the housing, a contact assembly, and a press assembly buckled on the housing; the electromagnetic assembly including a coil holder and an actuating plate, the actuating plate being pivotally mounted on the coil holder, the actuating plate having an interlocking end and a magnetic end, the magnetic end being located on the coil holder; the contact assembly including a contact seat and at least two opposing electrode plates, left and right sides of the contact seat being provided with accommodation troughs respectively, the contact seat being provided with at least one elastic seat, two ends of the elastic seat having movable contacts in communication with each other; the electrode plates being located at front and rear sides of the contact seat respectively, one of the electrode plates being in communication with the coil holder, the electrode plates being inserted and mounted to an inner bottom of the housing, each electrode plate having a vertically bent immovable contact at a top end thereof, the movable contacts of the elastic seat being adapted to get contact with or separated from the immovable contacts of the electrode plates; a power-on button and a power-off button being provided on an outside of the press assembly, the power-on button corresponding to the magnetic end of the actuating plate, the power-off button being located above the contact seat, the interlocking end being used to drive the contact seat; characterized by: a power-off key being provided between the press assembly and the contact seat, two sides of a bottom of the power-off key having positioning rods corresponding to the accommodation troughs respectively, the positioning rods being sleeved with elastic members and mounted in the accommodation troughs respectively, one end of each elastic member leaning against the bottom of the power-off key, another end of each elastic member being spaced a determined distance apart from a top end of the contact seat, a bottom of the power-off button being pressed against a top of the power-off key; the power-off key being provided with at least one press portion extending downward for pressing the elastic seat, wherein a lower end of each positioning rod extends downward to form the press portion, a bottom of the each accommodation trough is formed with a perforation, and the press portion passes through the perforation to press the elastic seat.

2. The electromagnetic switch protection structure as claimed in claim 1, wherein the contact seat is provided with a through hole corresponding to the perforation, and the press portion further passes through the through hole to press the elastic seat.

* * * * *